United States Patent [19]

Troscinski

[11] Patent Number: 4,896,513

[45] Date of Patent: Jan. 30, 1990

[54] MAKING ICE IN A REFRIGERATOR

[75] Inventor: David W. Troscinski, Woodridge, Ill.

[73] Assignee: Eaton Corporation, Cleveland, Ohio

[21] Appl. No.: 270,563

[22] Filed: Nov. 14, 1988

[51] Int. Cl.[4] ..... F25C 5/08

[52] U.S. Cl. ..... 62/351; 62/353

[58] Field of Search ..... 62/71, 73, 351, 353

[56] References Cited

U.S. PATENT DOCUMENTS

| | | | |
|---|---|---|---|
| 2,415,446 | 2/1947 | Shoemaker | 62/71 |
| 2,717,497 | 9/1955 | Knerr | 62/353 X |
| 3,064,442 | 11/1962 | Bougie et al. | 62/353 X |

*Primary Examiner*—William E. Tapolcai

*Attorney, Agent, or Firm*—R. A. Johnston

[57] ABSTRACT

An icemaker for a refrigerator having a stationary tray with plural curved-bottom cavities for molding crescent ice. An electrical heater melts the ice surface of the tray bottom to permit freeze embedded ejector tine of a rotary harvesting means to sweep the crescent ice from the tray. A stationary stripper cam surface forces the ice radially from the ejector tine which has wedging surfaces thereon to facilitate fracture of the ice for harvesting into half-crescent sections.

7 Claims, 3 Drawing Sheets

Fig. 9
Fig. 10
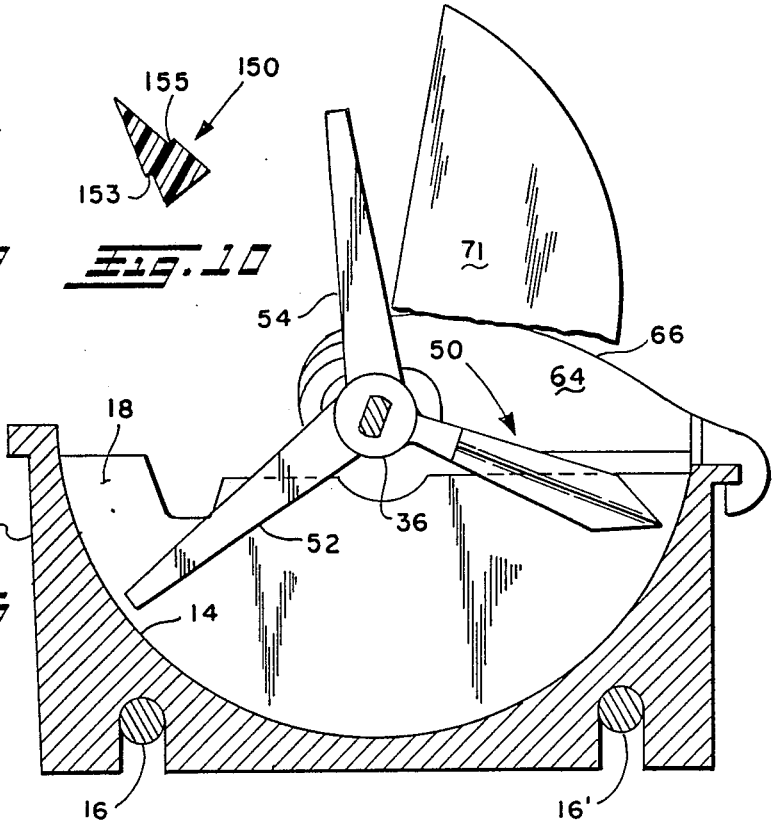
Fig. 5
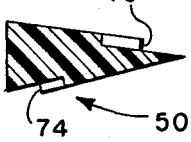
Fig. 7
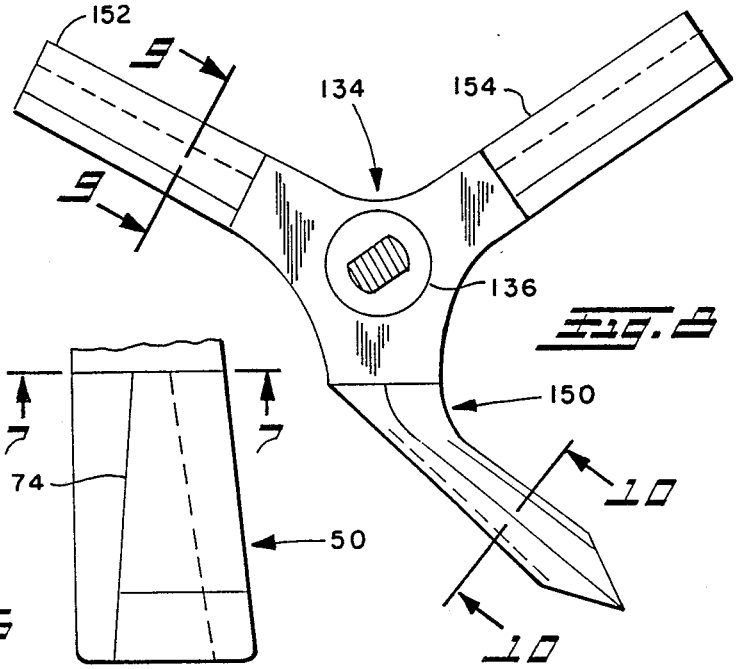
Fig. 8
Fig. 6

MAKING ICE IN A REFRIGERATOR

CROSS-REFERENCE TO RELATED APPLICATION

The present invention is related to the subject matter described in co-pending application Ser. No. 258,308 filed Oct. 17, 1988, in the name of Frank Karlovits entitled "Making Ice In A Refrigerator" and assigned to the assignee of the present invention.

BACKGROUND OF THE INVENTION

The present invention relates to devices for molding and harvesting formed ice in a refrigerator for use in cooling beverages and particularly in cooling beverages in individual drinking containers. In providing icemakers for household refrigerators, it is known to form ice in a stationary tray having individual compartments with a curved bottom to provide the formed ice with a generally crescent-shaped configuration. Crescent-shaped ice is typically harvested by heating the tray an amount sufficient to cause a slight amount of melting at the tray/ice interface to enable the crescent ice to be swept from the curved bottom cavity by a rotating comb.

In the above-referenced Karlovits application, such a rotary melt-out icemaker for harvesting crescent ice has been described wherein an arm or tine of the comb is immersed in the waterfill in the cavity or mold and embedded in ice frozen therein to enable harvesting by rotating the embedded comb for sweeping the crescent ice from the cavity. As the crescent ice is swept out of the cavity the level surface of the ice contacts stationary ejectors to cause stripping of the ice from the tine and simultaneous fracturing to thereby provide two half-crescent or quarter-round ice shapes from a single crescent-shaped ice formation.

However, in providing the simultaneous stripping and fracturing of the crescent ice from the rotating harvesting tine by cam action of the crescent ice against the stationary ejector or stripper, problems have been encountered in providing the optimization of stripping and fracturing by pressing the ice against the stationary stripper as the tines of the comb are rotated during the harvesting cycle. In particular, difficulty has been encountered in causing the crescent ice to fracture as it is radially stripped from the rotating harvesting tine, inasmuch as the forces of the camming surface of the stripper tend to move the ice in a radial direction from the rotating tine; and in some instances, insufficient forces have been provided to cause fracturing and splitting of the crescent into the half-crescent shape.

Accordingly, it has been desired to provide a way or means of ensuring that harvested crescent ice in a refrigerator icemaker is split or fractured into two half-crescent sections as it is harvested from the mechanism for providing the optimum configuration for iced beverages in individual glasses or cups.

SUMMARY OF THE INVENTION

The present invention provides an icemaker for a household refrigerator having a stationary ice forming tray provided with a plurality of curved bottom compartments and a heater for melting the ice/tray interface to enable rotary sweep harvesting of the individual crescent ice from the mold cavities. Harvesting comb tines are immersed in the cavity water fill and frozen embedded in the crescent ice. Upon energization of the tray heater, melt-out occurs at the ice/tray interface along the curved bottom and partition sides thereby permitting rotation of the harvesting comb to sweep the ice from the mold cavity. Stripping and splitting of the ice from the comb into two half-crescent sections from each molded ice crescent occurs as the crescent ice contacts a camming surface on stationary strippers.

The present invention provides a unique tapered or wedge shape to the harvesting comb tines to effect a splitting action to the crescent ice to augment and facilitate fracture of the crescent-shaped ice into two half-crescent sections simultaneously as the ice is radially stripped from the harvesting tines. The present invention thus ensures simultaneous fracturing and splitting of crescent ice during stripping of the ice from the harvesting comb.

BRIEF DESCRIPTION OF THE DRAWINGS

FIG. 5 is a view similar to FIG. 4 and shows the harvesting means rotated an additional 60 degrees clockwise from the position shown in FIG. 4;

FIG. 6 is a view taken along section-indicating lines 6—6 of FIG. 1.

FIG. 7 is a sectional view taken along section-indicating lines 7—7 of FIG. 6;

FIG. 8 is a view of an alternate form of the harvesting means;

FIG. 9 is a section view taken along section-indicating lines 9—9 in FIG. 8; and FIG. 10 is a section view taken along section-indicating lines 10—10 in FIG. 8.

DETAILED DESCRIPTION

Figure 1:
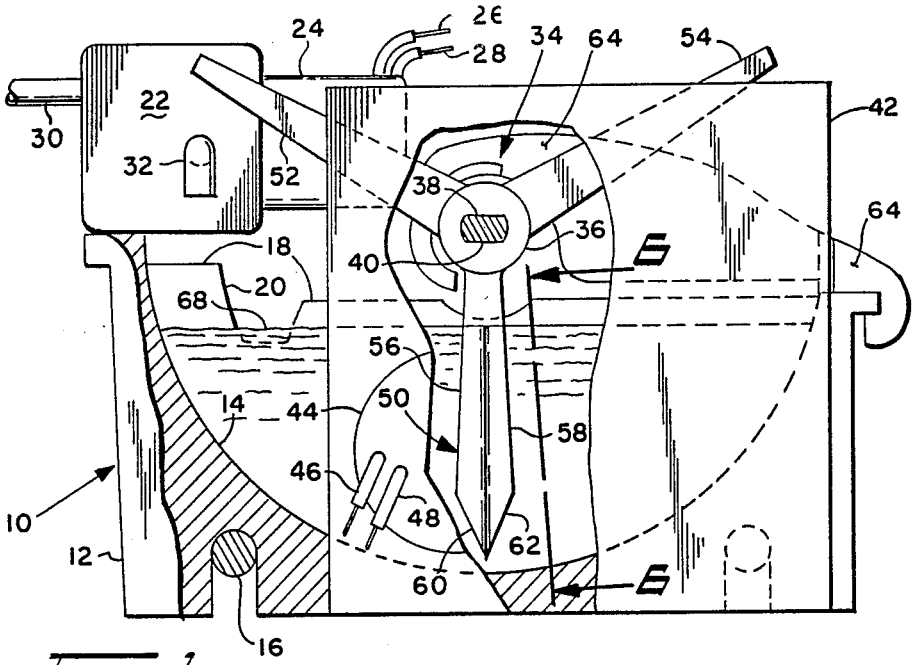
FIG. 1 is an end view of the icemaker of the present invention with portions of the motor drive mechanism broken away to show the harvesting means.

Referring to FIG. 1, the icemaker assembly is indicated generally at 10 and has a stationary tray 12 preferably formed of a light metal such as aluminum or other material having a high coefficient of thermal conductivity and has formed therein a plurality of curved bottom ice forming cavities one of which is indicated by reference numeral 14. Tray 12 has a generally U-shaped groove provided in the bottom thereof in which is pressed an electrical resistance heater having a generally U-shaped configuration, one leg of which is denoted by reference numeral 16 in FIG. 1. The curved bottom ice cavity is separated from the adjacent cavity by a partition or side wall 18 which has a suitable weir 20 formed therein to permit water fill to flow between adjacent cavities for complete filling of the tray. Water fill is provided by a suitable electrically operated valve 22 which is actuated by a solenoid 24 which has electrical leads 26, 28 adapted for attachment to an electrical programmer (not shown). The valve has an inlet 30 adapted for connection to a source of water and an outlet 32 positioned to discharge water into the tray cavity adjacent the valve. In the presently preferred practice the valve 22 is disposed at the end of the tray opposite that shown in the foreground in FIG. 1.

A harvesting means, indicated generally at 34, is disposed immediately above the center of the row of ice cavities, such as the cavity 14 and includes a shaft 36 disposed above the tray and oriented generally longitudinally with the length of the tray and journalled in suitable supports (not shown) for rotation with respect thereto. One end of the shaft 36 has drive engaging surfaces shown as a pair of flats 38, 40 which engage a suitable speed reducer driving mechanism 42 disposed on the near end of the tray as shown in FIG. 1. Speed reducer 42 is driven by a suitable timing motor 44 with leads 46, 48 adapted for connection to a source of power as, for example, a thermostatic switch (not shown) connected to a power line.

Shaft 36 has mounted thereon at a longitudinal station corresponding to each of the ice forming cavities such as cavity 14 a member having a plurality of arms or tines one of which comprises an ejector indicated generally by the reference numeral 50. At least one and preferably two auxiliary tines 52, 54 are provided in accurately spaced arrangement with respect to the ejector tine 50, with the tines 50, 52 and 54 being preferably disposed in equally spaced arrangement.

The ejector tine 50 beginning at its root adjacent shaft 36, tapers outwardly to have its greatest transverse width, e.g. width in a direction at right angles to the radius thereof, located radially at approximately four-fifths (4/5ths) of its length and the tine 50 tapers from its maximum width in a converging manner to an apex at its radial extremity with the plane of the taper generally at right angles to the axis of rotation of shaft 36.

The outwardly tapering sides of the ejector tine 50 are denoted by reference numerals 56, 58 in FIG. 1; and, the converging surfaces denoted by the reference numerals 60, 62 in FIG. 1.

Figure 2:
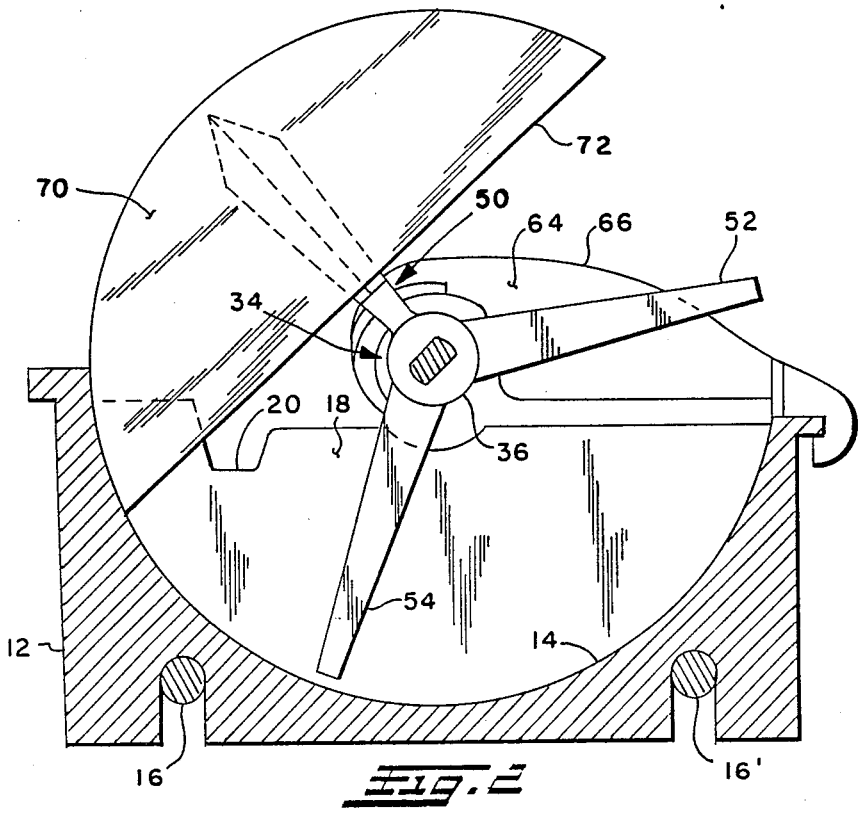
FIG. 2 is an end view similar to FIG. 1 with the drive means omitted showing the ice in the first stage of harvest.

Referring to FIGS. 1 and 2, each of the curved bottom mold cavities, such as cavity 14, has a stationary stripper 64 disposed thereabove and has the upper surface thereof formed in a generally constant radius curvature in a region around shaft 36 with the remaining portion of the upper surface 66 disposed to the right of shaft 36 in the drawings, formed as a camming surface to provide a radially outwardly stripping action as will hereinafter be discussed.

In operation, solenoid 24 is energized by a suitable program switch (not shown) and the tray 12 has its mold cavities filled to the desired water level indicated by reference numeral 68 whereupon the power to the solenoid is terminated and valve 22 closes. The harvesting means 34 is positioned such that the ejector tine 50 is disposed vertically downward into the water fill as shown in solid outline in FIG. 1.

The water fill in the mold cavity is then permitted to freeze forming crescent ice in each of the cavities having the curved bottom 14. Upon thermostatic detection by any convenient means (not shown) that the water fill in tray 12 has frozen, the electrical heater 16 is energized by a suitable electrical switch (not shown) and motor 44 is simultaneously energized. However, in view of the friction forces of the ice against the curved bottom 14 of each cavity, the motor is stalled and harvesting means 34 is unable to rotate. However, upon the heater 16 raising the tray temperature to a point whereupon surface melting occurs along the curved bottom of each cavity, the ejector tine 50 begins to rotate in a clockwise direction. When the harvesting means has rotated from the position shown in FIG. 1 through a central angle of approximately 135 degrees to the position shown in FIG. 2, the formed crescent ice 70 is in the position shown in FIG. 2 whereupon the straight surface 72 of the crescent ice has just made contact with the cam surface 66 of the stripper 64.

Figure 3:
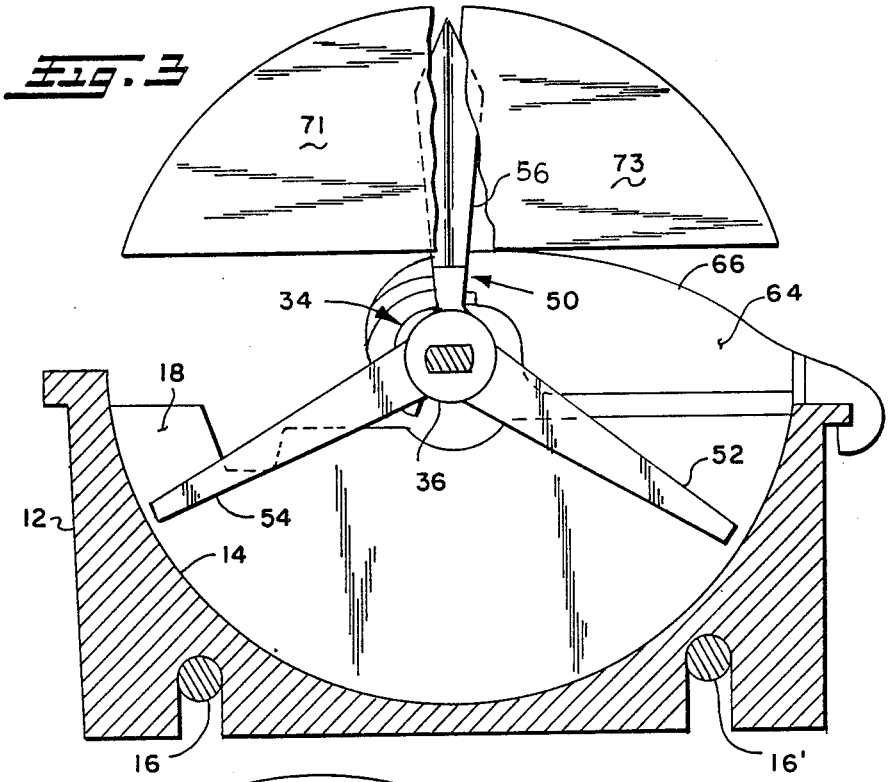
FIG. 3 is a view similar to FIG. 2 with the harvesting means rotated an additional 40 degrees clockwise from the position of FIG. 2.

Referring to FIG. 3, continued clockwise rotation of the shaft 36 from the position of FIG. 2 through a central angle of approximately 45 degrees, to the position shown in FIG. 3, causes the cam surface 66 to force the crescent ice radially outwardly along the ejector 50 whereupon the edges 56, 58 have caused fracture of the crescent ice into two half sections 71, 73 as shown in solid outline in FIG. 3.

Figure 4:
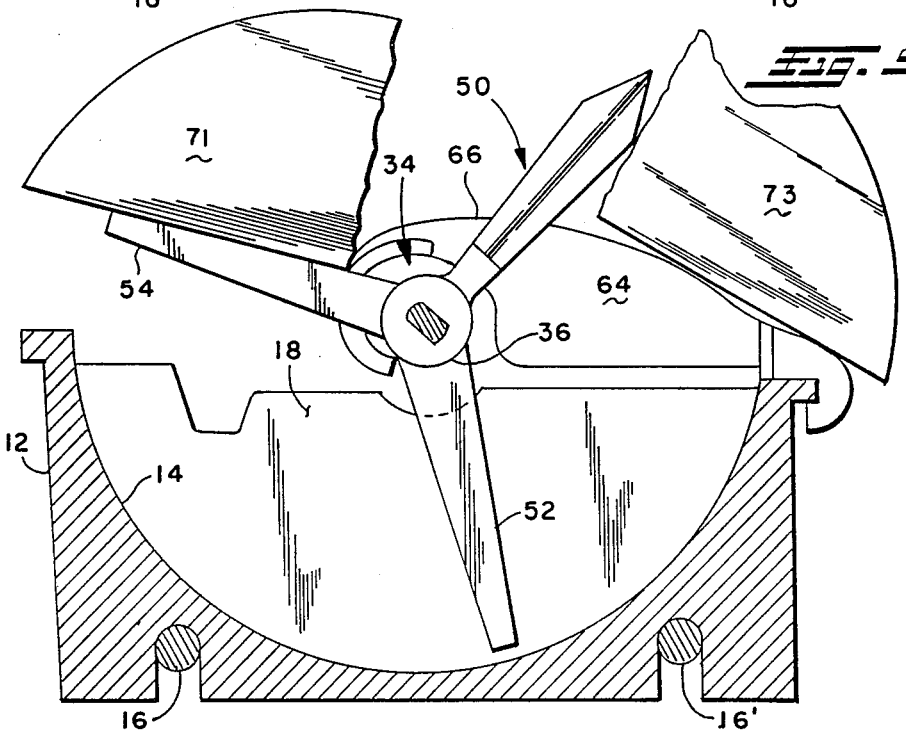
FIG. 4 is a view similar to FIG. 3 showing the harvesting means rotated an additional 45 degrees clockwise from the position shown in FIG. 3.

Referring to FIG. 4, continued clockwise rotation of the shaft 36 from the position shown in FIG. 3, through a central angle of approximately 45 degrees to the position shown in FIG. 4 causes the half-crescent ice section 73 to be ejected from the strippers to fall into a receptacle (not shown). The second half-crescent portion of ice 71 falls upon the auxiliary harvesting arm or tine 54 which prevents the section 71 from falling back into the tray cavity.

Referring to FIG. 5, continued clockwise rotation of the shaft 36 from the position shown in FIG. 4 through a central angle of approximately 60 degrees causes the auxiliary arm or tine 54 to eject the remaining half crescent ice section 71 from the strippers 64 and thus completes the harvesting of the ice. Upon return of the ejector tine 50 to the position shown in FIG. 1, the icemaker is in condition for refilling of the tray with water and start of another freezing cycle.

Referring to FIGS. 6 and 7, the ejector arm or tine 50 preferably has undercuts, indicated by reference numerals 74, 76 in FIGS. 6 and 7 provided along opposite faces thereof and these are inclined in the radial direction to facilitate fracture of the ice during radial movement along the ejector arm 50.

Referring to FIGS. 8 through 10, an alternate form of the harvesting means is illustrated at 134 as having a plurality of arms or tines 150, 152, 155 rotatable shaft 136. The ejector tine indicated generally by reference numeral 150 has a radially curved or scimitar-shaped configuration as shown in FIG. 8 and is circumferentially equally spaced with a pair of auxiliary arms 152, 154. With reference to FIG. 9, a typical cross-section of the auxiliary arms is illustrated for arm 152 and has a rectangular-shape in tranverse section with the elongated side of the rectangle inclined at an angle to the axis of the shaft 136 to thereby provide an inclination or axial pitch to the auxiliary arms shown typically in FIG. 9. The inclination to the arms 152, 154 facilitates circulation of cold air above the tray for freezing.

Referring to FIG. 10, the ejector tine 150 is shown in transverse section as having inclined undercuts 153, 155 provided on opposite faces thereof to facilitate fracture of the crescent ice. It will be understood that the undercuts 153, 155 are similar to the undercuts 74, 76 of FIGS. 6 and 7.

The invention thus provides melt-out rotary icemaker having an ejector tine of the rotary harvesting means embedded in the crescent ice. The sides of the ejector tine have a reverse taper to provide a wedging action during stripping to facilitate fracture and splitting of the molded crescent ice formed in each mold cavity into two half-crescent sections.

Although the invention has hereinabove been described with respect to the illustrated embodiments, it will be understood that the invention is capable of modification and variation and is limited only by the following claims.

I claim:

1. A melt-out icemaker for use in a refrigerator and of the type having tray means with a plurality of curved-bottom ice molding cavities disposed in closely spaced aligned relationship;

electrically operated valve means for providing a measured flow of water to said cavities for forming crescent ice therein;

heating means operable upon electrical energization for heating said tray means for effecting melting of said ice at the surface of said cavities;

harvesting means including an ejector arms embedded in the formed ice in each cavity and rotatable for sweeping ice from said cavities and operable to break said formed ice from each of said cavities into plural segments upon radial stripping of formed ice from the arms wherein the improvement comprises:

said ejector arms each having wedge shaped surfaces provided thereon operative to facilitate said breaking of said formed crescent ice into plural segments upon said radial stripping of said ice from said ejector arm.

2. The icemaker defined in claim 1, wherein said ejector arm is tapered radially inwardly and outwardly for forming said wedging surface.

3. The icemaker defined in claim 1, wherein said ejector arm is tapered in transverse cross-section.

4. The icemaker defined in claim 1, wherein said ejector arm is curved in the radial direction.

5. The icemaker defined in claim 1, wherein said ejector arm is curved in the radial direction and has a tapered configuration in transverse section.

6. The icemaker defined in claim 1, wherein said ejector arm has first and second wedging surfaces thereon operable to provide splitting forces.

7. The icemaker defined in claim 1, wherein said harvesting means includes a catcher arm circumferentially spaced from said ejectro arm, said catcher arm operative to prevent said split ice from falling into said tray cavity.

* * * * *